US005565832A

United States Patent [19]

Haller et al.

[11] Patent Number: 5,565,832

[45] Date of Patent: Oct. 15, 1996

[54] SOLENOID WITH MAGNETIC CONTROL OF ARMATURE VELOCITY

[75] Inventors: John J. Haller, Boonton; Stanley B. Roedel, Hackettstown, both of N.J.

[73] Assignee: Automatic Switch Company, Florham Park, N.J.

[21] Appl. No.: 331,023

[22] Filed: Oct. 17, 1994

[51] Int. Cl.[6] ..... H01F 7/12

[52] U.S. Cl. ..... 335/249; 335/247; 335/261; 335/262; 335/271; 335/277; 335/279; 335/281

[58] Field of Search ..... 335/247, 248, 335/249, 257, 261, 262, 271, 277, 279, 281

[56] References Cited

U.S. PATENT DOCUMENTS

| | | | |
|---|---|---|---|
| 2,407,963 | 9/1946 | Persons | 335/260 |
| 2,888,233 | 5/1959 | Windsor | 335/245 |
| 3,168,242 | 2/1965 | Diener | 236/75 |
| 3,805,204 | 4/1974 | Petersen | 335/255 |
| 4,008,448 | 2/1977 | Muggli | 335/258 |
| 4,522,372 | 6/1985 | Yano et al. | 251/141 |
| 4,583,067 | 4/1986 | Hara | 335/261 |

*Primary Examiner*—Brian W. Brown
*Assistant Examiner*—Raymond M. Barrera
*Attorney, Agent, or Firm*—Levine & Mandelbaum

[57] ABSTRACT

A low-noise solenoid has an armature with a projecting ridge receivable within a groove in a pole piece. As the ridge enters the groove, the magnetic force which opposes a return spring decreases until there is equilibrium whereat the armature remains suspended without impacting upon the pole piece.

5 Claims, 3 Drawing Sheets

FIG. 1
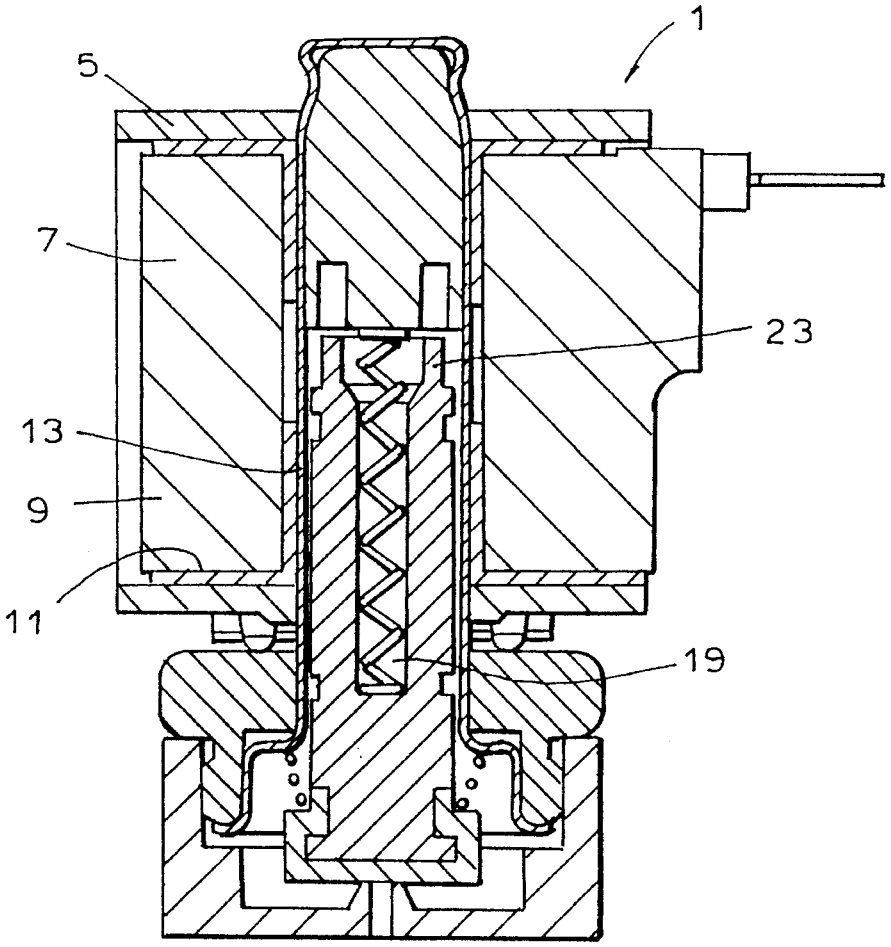
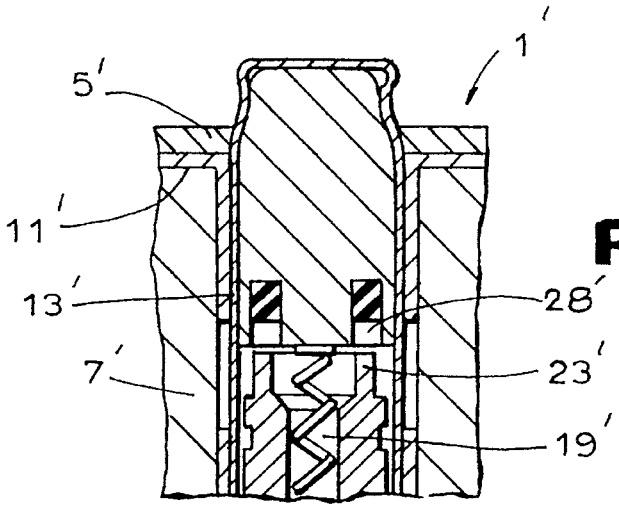
FIG. 3

FIG. 2
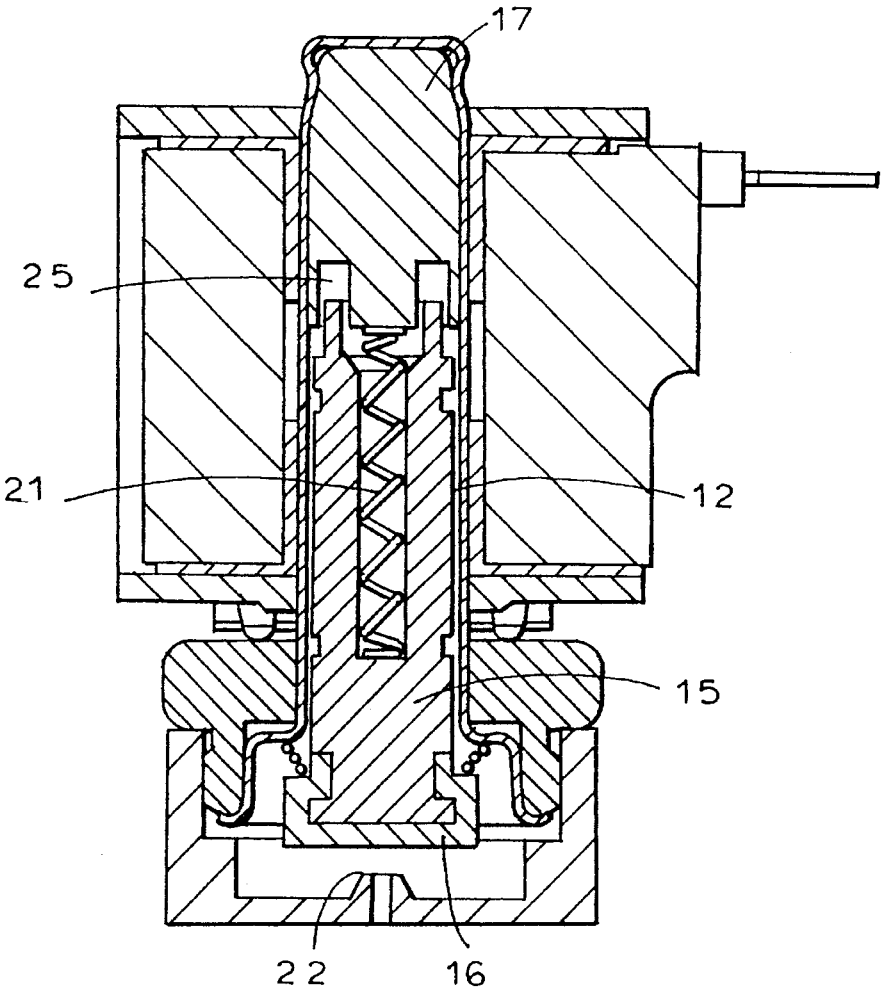
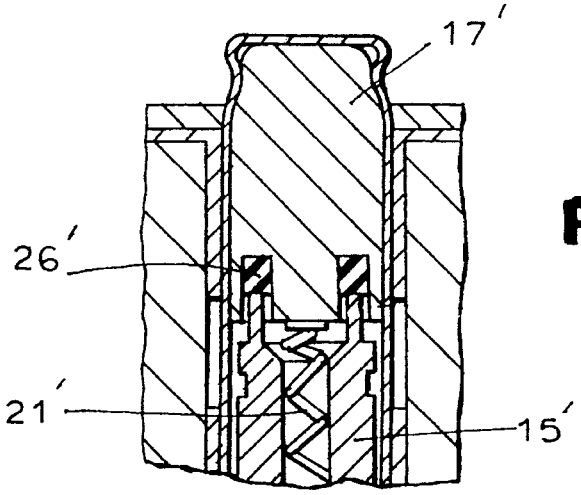
FIG. 4

SOLENOID WITH MAGNETIC CONTROL OF ARMATURE VELOCITY

BACKGROUND OF THE INVENTION

This invention relates to a low noise solenoid valve. More specifically, the invention is directed to a solenoid valve wherein the noise caused by impact of the armature against the pole piece during opening of the valve, and against the valve seat during closure of the valve is substantially reduced.

It is known in the art to utilize an electric solenoid to open and close a valve by fitting one end of the solenoid armature with a resilient valve member to selectively seal and expose the opening in a valve seat in the path of fluid flow from an inlet port to an outlet port. In a normally closed valve, a return spring biases the armature toward the valve seat so that the valve member is in sealing engagement with the opening in the valve seat when the coil of the solenoid is not energized. Upon energization of the coil, the armature is drawn away from the valve seat to expose its opening and permit fluid flow.

As the armature is drawn away from the valve seat by the magnetic force imparted by the energized coil, it is accelerated toward the pole piece upon which it impacts with an audible "click." Thereafter, while the solenoid remains energized, there is often an audible "hum" while the armature remains in engagement with the pole piece. The hum is usually due to a ripple in the amplitude of the solenoid current waveform which causes the electromagnetic force holding the armature against the pole piece in opposition to the constant force of the return spring to fluctuate.

When the valve is deenergized, the electromagnetic force holding the armature against the pole piece decays and the force of the return spring accelerates the armature toward engagement with the valve seat. Contact of the valve member on the valve seat causes a further sound which may be undesirable.

It is known in the art to reduce valve noise by providing an elastomeric member between the armature and pole piece to absorb the impact which follows energization. This approach is of limited effectiveness in reducing noise during energization and has no effect on valve noise resulting from deenergization.

Another approach taken in the prior art is to employ a movable armature and no pole piece. This technique can be used to prevent contact between the pole piece and armature during energization. However, again, this does nothing to prevent noise following deenergization. Moreover, this technique is magnetically inefficient thereby requiring a larger solenoid to accomplish a given task.

SUMMARY OF THE INVENTION

The aforementioned problems of the prior art are overcome by the instant invention which provides for a solenoid, operable by a source of electric current, and having a core tube with two opposite ends and a winding circumscribing the core tube. A stationary pole piece is mounted at one end of the core tube, and an axially reciprocable armature is slidably mounted in the core tube for movement between an energized position adjacent the pole piece when the winding is energized and a deenergized position distal from the pole piece. One of the movable armature and the stationary pole piece has an axially extending projection in the form of a circular ridge, and the other has a complementary groove in the form of a circular channel for receiving the projection when the armature is in the energized position. There is a return spring mounted within the core tube for applying a return force to the armature for urging the armature toward the deenergized position. The winding has an operating current range in which the pole piece exerts a magnetic force on the armature greater than the return force when the projection means is out of the groove. The pole piece exerts a magnetic force on the armature equal to the return force at an equilibrium position of the armature at which the projection means is received in the groove.

It is therefore an object of the invention to provide an electric solenoid actuator with an armature having a velocity which can be controlled to reduce the force of impact against the solenoid pole piece.

Another object of the invention is to provide an electric solenoid actuator wherein the electromagnetic force imparted to the armature when the coil is energized decreases as the armature approaches the pole piece.

Still another object of the invention is to provide an electric solenoid actuator wherein the electromagnetic force which urges the armature toward the pole piece when the coil is energized approaches the magnitude of the return force exerted on the armature near the point of engagement with the pole piece.

A further object of the invention is to provide an electric solenoid actuator with an armature that has a geometry which varies the magnetic force on it as a function of distance from the pole piece.

Still a further object of the invention is to provide an electric solenoid actuator with a pole piece having a geometry complementary to the geometry of the armature for cooperative interaction to reduce the force of attraction between the armature and pole piece near the point of mutual engagement.

Other and further objects of the invention will be apparent from the following drawings and description of a preferred embodiment of the invention in which like reference numerals are used to indicate like parts in the various views.

BRIEF DESCRIPTION OF THE DRAWINGS

FIG. 1 is a sectional elevation view of a first preferred embodiment of the invention in a first disposition.

FIG. 2 is a sectional elevation view of the first preferred embodiment of the invention in a second disposition.

FIG. 3 is a partial sectional elevation view of a second preferred embodiment of the invention in a first disposition.

FIG. 4 is a partial sectional elevation view of the second preferred embodiment of the invention in a second disposition.

DESCRIPTION OF THE PREFERRED EMBODIMENT

Figure 5:
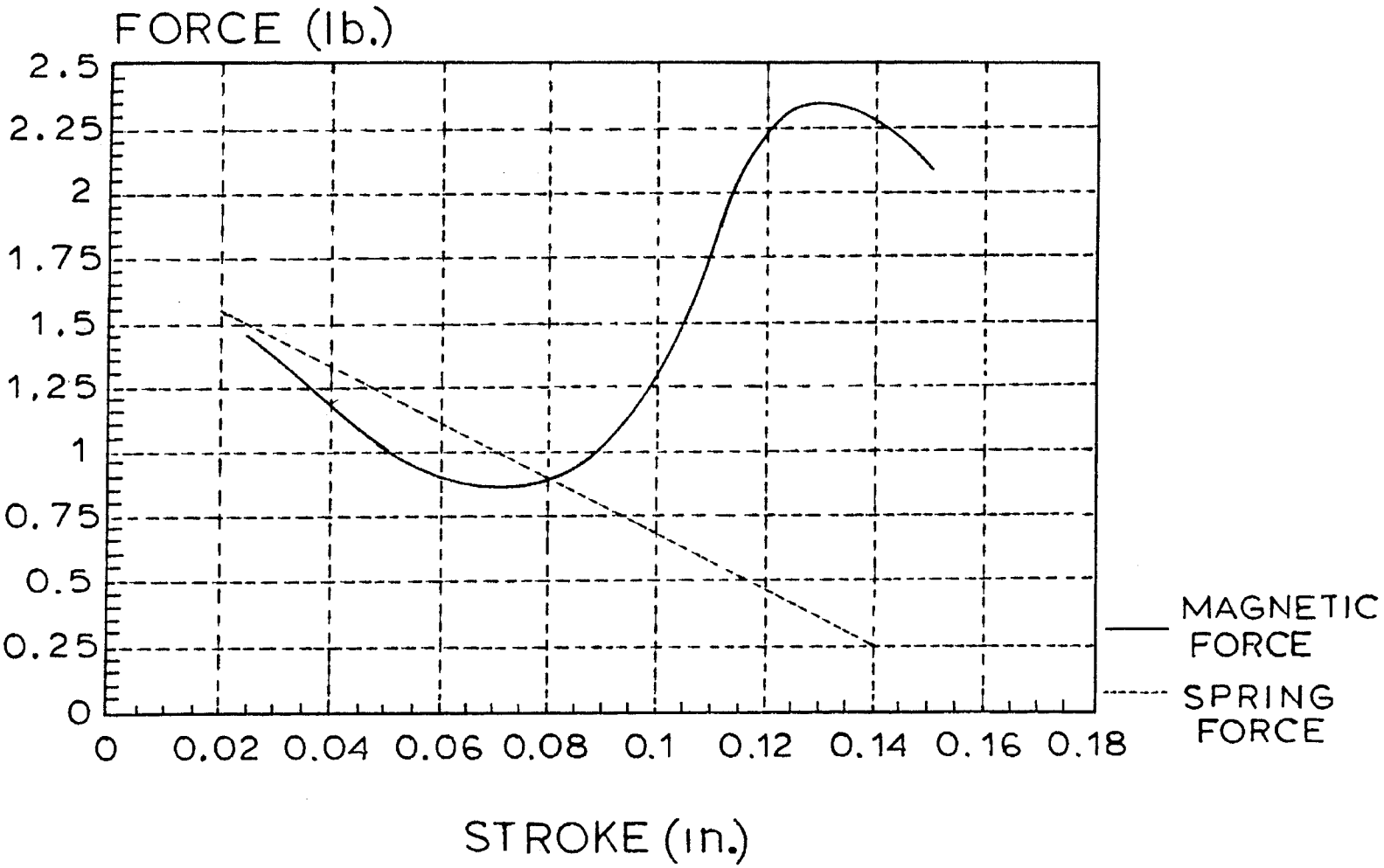
FIG. 5 is a graphical view of the force versus stroke characteristic of the preferred embodiments of the invention.

Referring now to FIGS. 1 and 2 of the drawings, there is shown a normally closed two-way solenoid valve 1 which is closed in FIG. 1 and open in FIG. 2. The solenoid valve 1 has an actuator which includes a yoke 5 of magnetic material, and an electrical coil 7. The coil 7 has a bobbin 11 and a winding 9. The bobbin 11 has a core tube 13 which serves as an armature guide. Within the cylindrical bore 12 in the core tube 13 is an axially reciprocable armature 15.

Mounted on the lower end of the armature 15 is a resilient valve member 16.

A pole piece in the form of a plug nut 17 of magnetic material is fixedly mounted in the upper region of the armature guide 13 and extends into the bore 12. The armature 15 has a blind cylindrical bore 19 in which there is disposed a coil spring 21 having a free end in engagement with plug nut 17. The spring 21 normally urges armature 15 toward a valve seat 22, that is to the normally closed position of the valve 1, whereat the valve member 16 seals an opening in the valve seat as can be seen in FIG. 1.

Circumscribing the open end of the armature bore 19 and extending upwardly from the upper end of the armature 15, in the views of FIGS. 1 and 2, is a projection in the form of a circumferential ridge 23 having a rectangular cross section. The ridge 23 is integral with and formed from the same magnetic material as the armature 15.

Formed within the lower end of the plug nut 17, in the disposition illustrated in FIGS. 1 and 2 is a circumferential groove 25 defining a channel having a rectangular cross section with a width slightly greater than the width of the ridge 23 for enabling the ridge 23 to be received in the groove 25 as the armature 15 is raised from its closed position shown in FIG. 1 toward its open position, shown in FIG. 2.

As the ridge 23 enters the groove 25, components of the force exerted by the plug nut on the armature change direction from axial to diametrical. The result is that the net axial lifting force exerted on the armature 15 decreases with entry of the ridge 23 in the groove 25.

The ridge 23 and groove 25 may be dimensioned in accordance with the spring constant of the return spring 21 so that the force of attraction between the plug nut 17 and the armature 15, which is grater than the opposing force of the return spring 21, can be made to decrease until the magnetic force on the armature is substantially equal to the return force exerted by spring 21 when the armature is raised to an energized position just short of contact with the plug nut 17.

In use, the solenoid 1 is normally in its closed state in which fluid flow through the opening in the valve seat 22 is prevented as shown in FIG. 1. In the closed state, the spring 21 urges the armature downwardly in the view of FIG. 1 to a deenergized position at which the valve member 16 engages the valve seat 22.

When the coil 7 is energized, the plug nut 17 exerts an upward magnetic force on the armature 15 great enough to overcome the downward force of the spring 21. The armature is then raised by the upwardly directed differential force thereby lifting the valve member 16 off of the valve seat 22 and permitting fluid flow through the opening in the valve seat 22.

The foregoing operation is typical of prior art valves. In a prior art valve, the armature 15 would continue its upward travel until it engaged the plug nut 17 thereby making an audible "click".

In the valve of the instant invention, after the armature is raised by the upwardly directed differential force to lift the valve member 16 off the valve seat 22, the ridge 23 begins to enter the groove 25. At that time the force of attraction of the plug nut 17 on the armature 15 begins to decrease until equilibrium between the magnetic lifting force and the return force exerted by the spring 21 is reached. Equilibrium occurs prior to engagement of the armature 15 with the plug nut 17. The armature then quietly floats at its energized position adjacent, but not engaging, plug nut 17, within the bore 12 of the core tube 13.

The foregoing description of a first preferred embodiment of the invention is most suitable for use with d.c. applications wherein the coil current has a constant level and the magnetic force exerted on the armature 15 at any position of the armature relative to the plug nut 17 is constant. However, in a.c. solenoid actuators, where a rectifier is used, the ripple in the coil current can cause a fluctuation in the magnetic armature lifting force. This can result in a electromagnetically induced vibration of the armature 15 in the core tube 13 while the valve is open. The amplitude of the vibration can be sufficient to cause periodic engagement between the ridge 23 of the armature 15 and the floor of the groove 25 in plug nut 17 resulting in an audible "buzz." The foregoing problem associated with a.c. solenoids is solved by a second preferred embodiment of the invention illustrated in FIGS. 3 and 4 of the drawings.

Referring now to FIGS. 3 and 4 of the drawings, there is shown a normally closed solenoid actuator 1' which is closed in FIG. 3 and open in FIG. 4. The solenoid actuator 1' includes a yoke 5' of magnetic material, and an electrical coil 7'. The coil 7' has a bobbin 11' and a winding 9'. The bobbin 11 has a core tube 13' which serves as an armature guide. Within the cylindrical bore 12' in the core tube 13' is an axially reciprocable armature 15'.

A pole piece in the form of a plug nut 17' of magnetic material is fixedly mounted in the upper region of the armature guide 13' and extends into the bore 12'. The armature 15' has a blind cylindrical bore 19' in which there is disposed a coil spring 21' having a free end in engagement with plug nut 17'. The spring 21' normally urges armature 15' toward the normally closed position of the valve 1'.

Circumscribing the open end of the armature bore 19' and extending upwardly from the upper end of the armature 15', in the views of FIGS. 3 and 4 is a circumferential ridge 23'. The ridge 23' is integral with and formed from the same magnetic material as the armature 15'.

Formed within the lower end of the plug nut 17', in the disposition illustrated in FIGS. 3 and 4 is a circumferential groove 25'. The structure of the actuator of the solenoid valve 1 and the solenoid actuator 1' are similar except as follows.

Seated within the groove 25' is a ring 26' made of a resilient rubber or plastic material. The axial thickness of the ring 26' in the disposition of FIGS. 3 and 4 is less than the axial height of the groove 25' leaving a circumferential recess 28' in which the ridge 23' can be received as the armature 15' is raised from its closed position as shown in FIG. 3 toward its open position as shown in FIG. 4.

As the ridge 23' enters the recess 28', components of the force exerted by the plug nut on the armature change direction from axial to diametrical. The result is that the net axial lifting force exerted on the armature 15' decreases with entry of the ridge 23' in the recess 28'. The ridge 23', groove 25', and ring 26' may be dimensioned in accordance with the spring constant of the return spring 21' so that the force of attraction between the plug nut 17' and the armature 15', which is greater than the opposing force of the return spring 21' can be made to decrease until the lowest value of fluctuating magnetic force on the armature 15' is just slightly greater than the return force exerted by spring 21' when the armature 15' is raised to a position of contact between the ridge 23' and ring 26'.

When the coil 7' is energized, the plug nut 17' exerts an upward magnetic force on the armature 15' great enough to overcome the downward force of the spring 21'. The ridge 23' enters the recess 28' and continues its upward travel until it engages the resilient ring 26'. At that time the force of attraction of the plug nut 17' on the armature 15' is just slightly greater than the return force exerted by the spring 21'. At its uppermost axial excursion, the ridge 23' is prevented by the ring 26' from impacting upon the surface of the ferromagnetic plug nut 17'. The resilient ring 26' can absorb the impact of the armature ridge 23' without noticeable sound.

In both of the preferred embodiments of the invention described above, impact of the valve member 16, 16' on the valve seat 22, 22' is softened by the gradual reduction of the electromagnetic attractive force exerted by the plug nut 17, 17' on the armature 15, 15'. When current to the coil 7, 7' is interrupted, a clamping diode (not shown) causes the electromagnetic force to gradually subside. Moreover, as the ridge 23, 23' is withdrawn from the groove 25, 25', the axial component of the attractive force between the plug nut 17, 17' and armature 15, 15' tends to increase. The net result is a gradually decaying electromagnetic force which resists the stronger force of the spring 21, 21' to lessen the downward acceleration of the armature 15, 15' and cushion the impact of the valve member 16, 16' on the valve seat 22, 22'.

Referring now to FIG. 5 of the drawings there is shown a graph of the force versus stroke characteristic of the actuators for the solenoids 1 and 1'. In FIG. 5, the horizontal axis corresponds to the stroke, i.e., the distance of the armature 15, 15' from the plug nut 17, 17'. The vertical axis corresponds to the force exerted on the armature 15, 15'. Separate curves are shown for the forces exerted by the spring 21, 21' and the magnetic field about the plug nut 17, 17'.

As can be seen, when the armature 15, 15' is in the deenergized position, i.e., about 0.14 inches from the plug nut 17, 17', an axial magnetic force of approximately 2.25 pounds pulls on the armature 15, 15' while a spring force of 0.25 pounds urges the armature toward the deenergized position. A differential force of 2.0 pounds lifts the armature to open the valve 1, 1'.

In solenoid 1, as the armature 15 approaches the plug nut 17, the attractive magnetic force decreases and the spring return force increases, thereby causing the differential lifting force to weaken until equilibrium is reached at a stroke of approximately 0.08 inches where the magnetic and spring forces are equal and the differential force has a zero magnitude.

As the armature 15 begins to overshoot the equilibrium position, the spring return force begins to exceed the magnetic lifting force thereby urging the armature to remain at the equilibrium position until the solenoid actuator is deenergized.

In solenoid 1', as the armature 15' approaches the plugnut 17', the attractive magnetic force decreases and the spring return force increases, thereby causing the differential lifting force to weaken until the ridge 23' contacts the resilient ring 26' at a stroke of approximately 0.09 inches where the magnetic force is just slightly greater than the spring force. The differential force of approximately 0.25 lbs. holds the ridge 23' against the ring 26'.

Upon deenergization of the solenoid actuator, as the amplitude of the magnetic force decreases, the equilibrium point at the intersection with the spring force characteristic moves gradually away from the plug nut 17, 17' to soften the impact of the valve member on the valve seat.

It is to be appreciated that the foregoing is a description of two preferred embodiments of the invention to which variations and modifications may be made without departing from the spirit and scope of the invention. For example, a projection can be provided on the pole piece of the solenoid for being received in a groove or recess on the armature as the armature approaches the pole piece. The location of the equilibrium position for the armature relative to the pole piece can be altered to suit the intended application for the solenoid actuator by varying the dimensions and geometry of the projection and groove in which it is to be received.

What is claimed is:

1. In a solenoid actuator selectively energizeable by a source of electric current, and having a core tube with two opposite ends and a winding circumscribing said core tube, a stationary pole piece mounted at one end of said core tube, and an axially reciprocable armature slidably mounted in said core tube for movement between an energized position adjacent said pole piece when said winding is energized and a deenergized position distal from said pole piece, the improvement wherein one of said movable armature and said stationary pole piece has axially extending projection means comprising a circular ridge having a rectangular cross section, and the other of said movable armature and said stationary pole piece has a complementary groove in the form of a circular channel with a rectangular cross section having a width slightly greater than the width of said ridge for receiving said projections means when said armature is in said energized position at an equilibrium position whereat said armature floats with no direct contact between said armature and stationary pole piece.

2. A solenoid in accordance with claim 1 wherein said armature comprises said projection means and said groove is in said pole piece.

3. A solenoid in accordance with claim 1 wherein said other of said movable armature and said stationary pole piece comprises an elastomeric member seated within said groove, said groove being deeper than the height of said member for leaving a recess into which said projection means can be received.

4. A solenoid in accordance with claim 1 further comprising bias means mounted within said core tube for applying a return force to said armature for urging said armature toward said deenergized position, said winding having an operating current range in which said pole piece exerts a magnetic force on said armature greater than said return force when said projection means is out of said groove and said pole piece exerts a magnetic force on said armature equal to the return force at an equilibrium position of said armature at which said projection means is received in said groove.

5. A solenoid in accordance with claim 4 wherein said projection means is spaced from the floor of said groove at said equilibrium position.

* * * * *